US006927353B2

(12) United States Patent
Bader et al.

(10) Patent No.: US 6,927,353 B2
(45) Date of Patent: Aug. 9, 2005

(54) DEVICE SWITCH FOR ELECTRIC HAND-HELD TOOLS

(75) Inventors: Thomas Bader, Landsberg (DE); Hans-Christian Donner, Karlsfeld (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/858,650

(22) Filed: Jun. 2, 2004

(65) Prior Publication Data

US 2005/0006217 A1 Jan. 13, 2005

(30) Foreign Application Priority Data

Jun. 7, 2003 (DE) ..... 103 25 922

(51) Int. Cl.[7] ..... H01H 13/02
(52) U.S. Cl. ..... 200/522; 200/61.39
(58) Field of Search ..... 200/522, 341, 200/333, 332.2, 318, 318.1, 321, 61.39, 61.85, 43.17

(56) References Cited

U.S. PATENT DOCUMENTS 3,711,666 A * 1/1973 Sahrbacker ..... 200/522
4,204,580 A * 5/1980 Nalley ..... 173/48
4,700,031 A * 10/1987 Claghorn et al. ..... 200/522
5,579,902 A * 12/1996 Kress ..... 200/522
6,794,594 B2 * 9/2004 Ching ..... 200/522
6,803,683 B2 * 10/2004 Bone et al. ..... 310/50

* cited by examiner

*Primary Examiner*—K. Lee
*Assistant Examiner*—Lisa Klaus
(74) *Attorney, Agent, or Firm*—Sidley Austin Brown & Wood, LLP

(57) ABSTRACT

A device switch (2) for a hand-held tool, particularly for a screw drill or drilling machine, having a control device (50) which is arranged in a switch housing (4), a trigger (6) which is movably supported at the switch housing (4), the rotational speed of a driving motor (52) of the hand-held tool being controlled by the control device (50) depending on the position of the trigger (6) relative to the switch housing (4), and a pressure increasing arrangement (10) with a contacting area (14) on a contacting element (12) which makes pressing contact with a contact region (26) of a mechanical resistance element (24) in a trigger pressure position of the trigger (6) between a zero load position and a full load position, the displacement resistance of the trigger (6) being increased by this mechanical resistance element (24). The contact region (26) is arranged outside the switch housing (4).

8 Claims, 3 Drawing Sheets

DEVICE SWITCH FOR ELECTRIC HAND-HELD TOOLS

BACKGROUND OF THE INVENTION

The invention is directed to a device switch for a hand-held tool, particularly for a screw drill or drilling machine, with a control device arranged in a switch housing, a trigger which is movably supported at the switch housing, the rotational speed of a driving motor of the hand-held tool being controlled by the control device depending on the position of the trigger relative to the switch housing, and a pressure increasing arrangement with a contacting element which makes pressing contact with a contact region of a mechanical resistance element in a center of pressure or trigger pressure position of the trigger between a zero load position and a full load position, the displacement resistance of the trigger being increased by this mechanical resistance element.

Hand-held tools of the type mentioned above make it possible for the user to press the trigger of the device switch initially only as far as the noticeable trigger pressure position even when there is a short displacement path of the trigger. In this position of the trigger, a workpiece can be pre-drilled at a relatively low rotational speed of the driving motor. As soon as the drill tip engages securely, the user can then actuate the trigger beyond the trigger pressure position by increasing pressing force on the trigger to continue the drilling process, e.g., at maximum speed of the driving motor. In this way, traditional center-punching of bore holes can be dispensed of when producing bore holes in metal or screwing to sensitive surfaces.

DE 30 16 488 discloses a device switch for a power tool in which a trigger has a contacting element in the form of an edge which comes into contact with a resistance element formed as a locking bushing along the movement path of the trigger. The locking bushing is held in the switch housing of the control device and is pressed by a pressure spring against a side of the trigger, which projects into the switch housing. When the edge and the locking bushing develop pressing contact, an appreciably increased pressure must be exerted on the trigger to push the edge of the trigger past the locking bushing to achieve an increase in the rotational speed of the driving motor.

A device switch of the type described above has the disadvantage that both the control device and the trigger must be specially shaped for setting up the trigger pressure position. In particular, the changes inside the switch housing require special authorization of the device switch and lead to very high production costs particularly in device series with relatively small piece numbers.

In addition, the known pressure increasing arrangement works not only in clockwise or clockwise rotation but also in counterclockwise rotation, which is troublesome rather than practical.

SUMMARY OF THE INVENTION

It is the object of the present invention to avoid the above-mentioned disadvantages and to reduce production costs in a device switch of a hand-held tool with an integrated pressure increasing arrangement.

According to the invention, this object is met by the contact region being arranged outside the switch housing and the pressing contact between the resistance element and contacting element therefore takes place at a distance from the switch housing. In this way, it is possible to realize a trigger pressure position of the device switch in a hand-held tool without having to make changes in the switch housing or control device. Therefore, a basic type of switch which is produced in large piece numbers and which is modified only outside the switch housing to set up the trigger pressure position can be used so that no separate authorization is required. In this way, the production costs for the device switch with trigger pressure position can be kept low even with hand-held tool series with low piece numbers.

The contact region is advantageously formed inside the trigger. The increase in the displacement resistance in the trigger pressure position can accordingly be achieved substantially through simple economical modification of the trigger.

The resistance element is preferably formed by a spring element which projects with the contact region into a guide space formed at the trigger in the unloaded state and can be swiveled out of this guide space at least partially. In addition, the contacting element is supported against the switch housing and has a contacting area which is displaceable in the guide space. A spring element of this kind can be constructed as a leaf spring. An adjusting lever for setting the rotating direction of the hand-held tool can serve as a contacting element. The displacement resistance in the trigger pressure position is accordingly increased in a simple and reliable manner.

In a particularly preferred embodiment form, a free second guide space, i.e. without mechanical barriers, is formed at the trigger. Accordingly, the contacting area can be displaced in one of the two guide spaces as selected. In this way, it is possible to provide means for switching the rotating direction in which the contacting area has its own guide for clockwise rotation and counterclockwise rotation, respectively. The hand-held tool can accordingly be operated in counterclockwise rotation without the influence of a mechanical resistance element. The respective guiding of the contacting area in one of the two guide spaces prevents damaging switching between the rotating directions during operation with both counterclockwise and clockwise rotation.

The position of the contact region is preferably adjustable. Accordingly, the trigger pressure position in which the noticeably greater resistance occurs when the rotational speed is increased is adjustable. In this way, the user can change the rotational speed used for pre-drilling a workpiece to adapt it to the respective hardness of different workpieces or to compensate for certain tolerances.

It is particularly advantageous when the contact region can be displaced by a spring base which is displaceably supported at the trigger and which holds the resistance element. This enables a particularly accurate positioning of the contact region when the trigger pressure position is adjusted and, therefore, an exact setting of the trigger pressure position.

A threaded element which is rotatable by an adjusting wheel is preferably arranged at the trigger and is mechanically coupled with the spring base. In this way, the contact region of the spring element can be positioned continuously and exactly inside the guide space. The mechanical coupling can be produced by forming the adjusting wheel in one piece with the threaded element.

The resistance element can advantageously make contact at a rear wall against which the contacting area strikes in a full load position of the trigger. This makes it possible to adjust the pressure increasing device such that the pressing contact between the contacting area of the contacting element and the contact region of the resistance element first occurs in the full load position of the trigger. In this way, the hand-held tool can also be operated without increasing the displacement resistance of the trigger in some areas.

SUMMARY OF THE INVENTION

The invention will be described more fully in the following description with reference to the drawings, wherein.

DETAILED DESCRIPTION OF THE INVENTION

Figure 1:
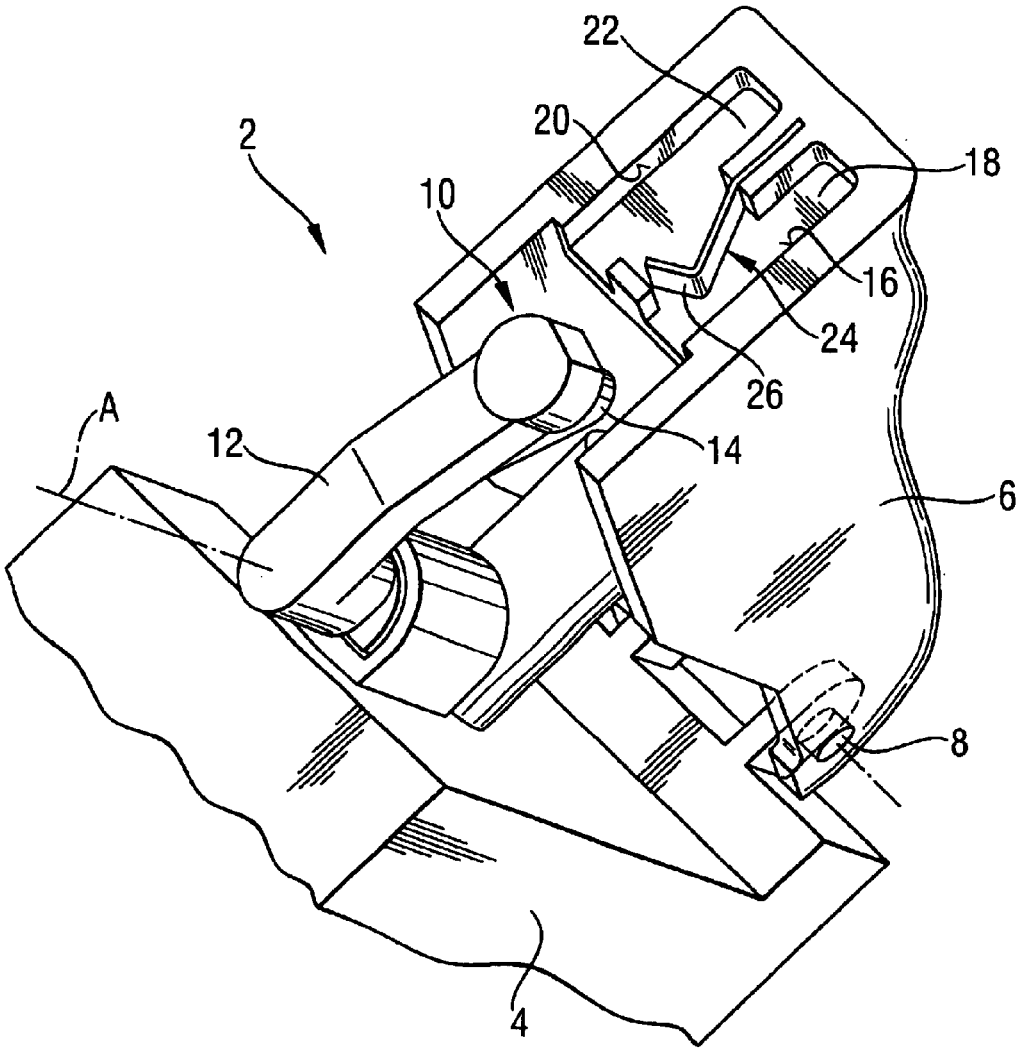
FIG. 1 shows a perspective view of the top of a device switch with a pressure increasing arrangement according to the invention.

FIG. 1 shows a device switch 2 for use in a hand-held tool, not shown, such as a drilling machine, drill/screwdriver, or screwdriver device. The device switch 2 has a switch housing 4 and a trigger 6, which is held at the switch housing 4 to be swivelable around a pin 8.

A pressure increasing arrangement 10 is arranged between the switch housing 4 and the trigger 6. This pressure increasing arrangement 10 has a contacting element 12, which is formed as an adjusting lever, and a contacting area 14 being arranged at its end on the trigger side. The contacting element 12 is supported at the switch housing 4 to be swivelable around an axis A.

A first guide slot piece 16, which partially encloses a first guide space 18, and a second guide slot piece 20, which partially encloses a second guide space 22, are formed at the trigger 6. The first guide space 18 guides the contacting area 14 when the hand-held tool rotates clockwise. The second guide space 22 guides the contacting area 14 when the hand-held tool rotates counterclockwise.

A resistance element 24 constructed as a leaf spring is fastened between the two guide spaces 18, 22. The resistance element 24 is shaped such that its contact region 26 projects into the first guide space 18 in the unloaded state. In contrast, the second guide space 22 has a free cross section over its entire length.

Figure 2:
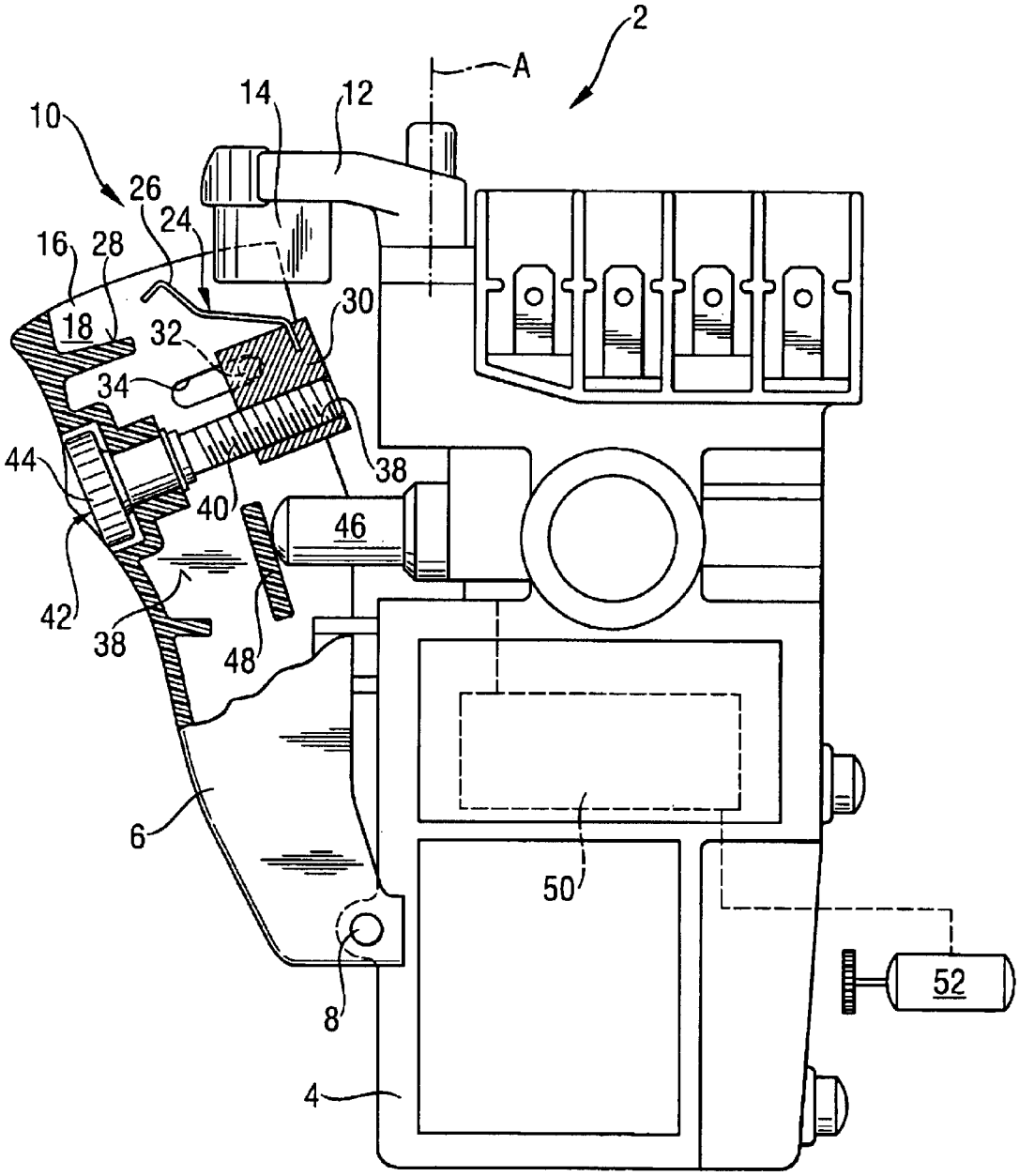
FIG. 2 is a side view in partial section through the device switch of FIG. 1 with an alternative pressure increasing arrangement according to plane II—II of FIG. 3.

FIG. 2 shows a device switch 2 with an alternative pressure increasing arrangement 10. Corresponding elements are designated by the same reference numbers as in FIG. 1.

In this embodiment of the pressure increasing arrangement 10, the resistance element 24 projects from a base 28 of the first guide slot piece 16, i.e. from below, into the first guide space 18. The resistance element 24 is fastened to a spring base 30. This spring base 30 has a guide cam 32 (shown in dashed lines) on at least one side. The guide cam 32 engages in a guide recess 34, which is fashioned on an inner side 36 of the trigger 6 and is guided at the trigger 6.

The spring base 30 has a threaded bore hole 38 into which a threaded element 40, in the form of a shaft of an adjusting device 42, is screwed. The adjusting device 42 has an adjusting wheel 44 which is mechanically coupled to the threaded element 40 and which is supported at the trigger 6 to be fixed axially and to be rotatable. The adjusting wheel 44 is recessed into the trigger 6 such that it can be turned from the outside.

FIG. 2 shows an actuating lever 46 which contacts a supporting element 48 projecting from the inner side 36 of the trigger 6 and is displaceable partially into the switching housing 4. As is shown schematically in FIG. 2, the actuating lever 46 communicates with a control device 50 accommodated in the switch housing 4. An electrical resistance of varying magnitude is measured in this control device by a potentiometer depending on the position of the actuating lever 46 or trigger 6. The rotational speed of a driving motor 52 of the hand-held tool with which the control device 50 communicates is controlled as a function of this resistance.

Figure 3:
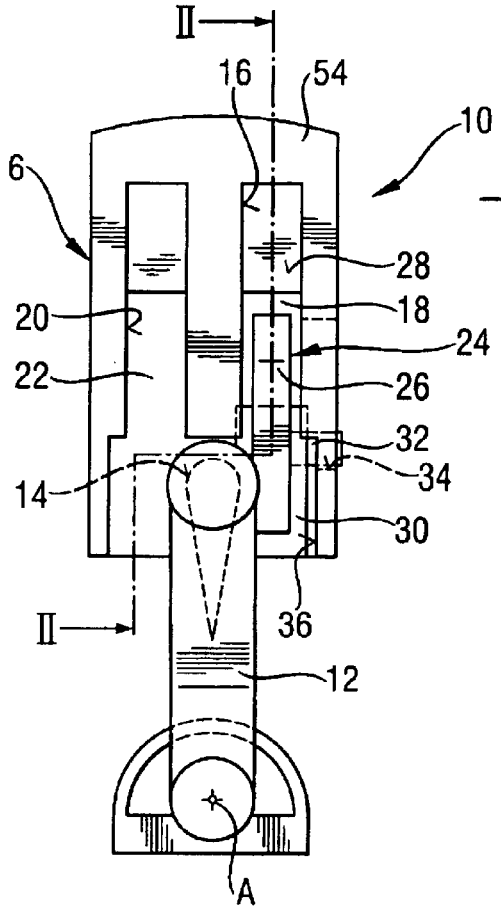
FIG. 3 shows a top view of the top of the pressure increasing arrangement of FIG. 2 in the zero load position.

As is shown in FIGS. 1 to 3, the trigger 6 is in a zero load position before a hand-held tool is put into operation with the device switch 2 according to the invention. In this zero load position, the trigger 6 projects from the switch housing 4 to the maximum extent. At the same time, the actuating lever 46 projects out of the switch housing 4 to the maximum extent and causes a maximum resistance in the control device 50. As a result, the rotational speed of the driving motor 52 is zero in this position of the trigger 6.

Prior to operation, as can be seen from FIG. 3, the contacting element 12 is initially in a neutral position in which the contacting area 14 does not project into either of the guide spaces 18, 22.

The user selects either counterclockwise rotation or clockwise rotation by means of an L/R switch, not shown, to put the hand-held tool into operation. The L/R switch is mechanically connected to the contacting element 12 (not shown).

The contacting area 14 with the contacting element 12 is swiveled in the direction of the first guide slot piece 16 when clockwise rotation is selected. The trigger 6 is swiveled around the pin 8 against the switching housing 4 through finger pressure upon the trigger 6 and displaces the actuating lever 46 into the switching housing 4 by the supporting element 48. The rotational speed of the driving motor 52 is progressively increased by the control device 50.

Figure 4:
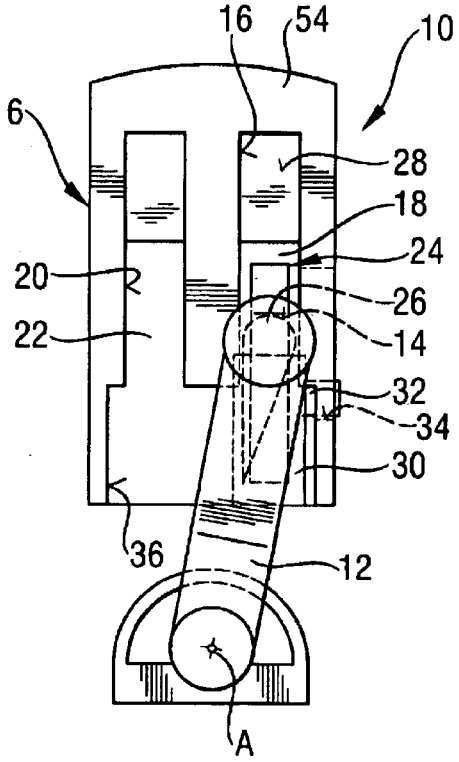
FIG. 4 shows a top view of the top of the pressure increasing arrangement of FIG. 2 in a trigger pressure position in clockwise rotation.

As is shown in FIG. 4, as soon as the contacting area 14 comes into contact, or pressing contact, with the contact region 26 of the resistance element 24, the resistance presented by the trigger 6 against finger pressure is appreciably greater. Accordingly, it is possible for the user to hold the trigger 6 in this trigger pressure position to pre-drill a workpiece to be machined at a substantially constant, low rotational speed.

As soon as a tool bit, not shown, of the hand-held tool or fastening means held at the latter engages in the workpiece to a sufficient degree, the user can increase finger pressure upon the trigger 6 until the resistance element 24 constructed as a leaf spring is bent out of the first guide space 18 at least far enough so that the contacting area 14 can slide past contact region 26. The trigger 6 can be swiveled in a direction of the switching housing 4 until a rear wall 54 thereof strikes against the contacting area 14. In this full load position of the trigger 6, a maximum rotational speed of the driving motor 52 is adjusted by the control device 50.

Figure 5:
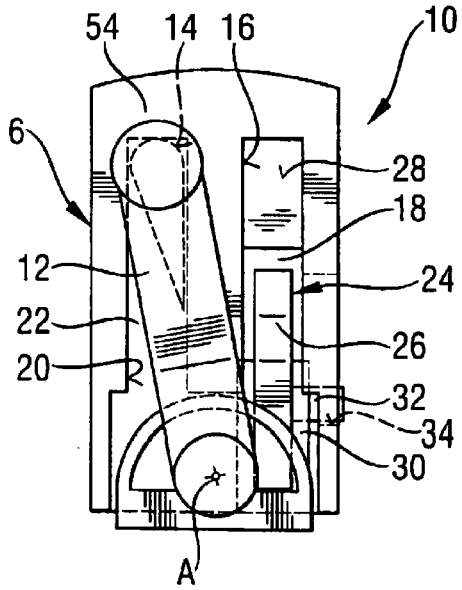
FIG. 5 shows a top view of the top of the pressure increasing arrangement of FIG. 2 in a full load position in counterclockwise rotation.

FIG. 5 shows the full load position of the trigger 6 for counterclockwise rotation. Since no trigger pressure position of the trigger 6 is needed in counterclockwise rotation and would even be troublesome, the second guide space 22 has a free cross section along its entire length. Accordingly, when actuating the trigger 6 in counterclockwise rotation, the full load position shown in FIG. 5 is achieved without a noticeable increase in the movement resistance of the trigger 6.

FIGS. 3 to 5 show the pressure increasing arrangement 10 according to the embodiment of the device switch 2 shown in FIG. 2. However, the pressure increasing arrangement 10 of the device switch 2 according to FIG. 1 functions the according to the same principle described above.

The substantial difference between the device switch 2 according to FIG. 2 and the embodiment of FIG. 1 is in the additional adjustability of the trigger pressure position of the trigger 6.

In the event that a change in the rotational speed of the driving motor 52 would be advantageous when pre-drilling a workpiece because of a particularly soft or hard quality of the workpiece, the contact region 26 of the resistance element 24 can be displaced in the first guide space 18. In this way, the pressing contact between the contacting element 12 and the resistance element 24 takes place in the manner of the adjustment already at a lower rotational speed or not until a higher rotational speed of the driving motor 52.

The adjustment is carried out by turning the adjusting wheel 44 on the outer side of the trigger 6. In so doing, the threaded element 40 of the adjusting device 42 is rotated. The threaded base is moved translationally along the guide recess 34 on the threaded element 40 through the rotating movement of the threaded element 40 and the contact region 26, along with the resistance element 24, is repositioned inside the first guide space 18.

In case a trigger pressure position or an increase in the displacement resistance of the trigger 6 in some areas is not desired in clockwise rotation of the hand-held tool, it is possible to locate the contact region 26 over the adjusting device 42 at the rear wall 54. In this way, the pressing contact between the contacting element 12 and the resistance element 24 does not occur until the full load position of the trigger 6.

What is claimed is:

1. A device switch (2) for an electric hand-held tool, such as one of a screw drill and drilling machine, with a control device (50) arranged in a switch housing (4), a trigger (6) being movably supported at the switch housing (4), the rotational speed of a driving motor (52) of the hand-held tool being controlled by the control device (50) depending on the position of the trigger (6) relative to the switch housing (4), and a pressure increasing arrangement (10) with a contacting area (14) on a contacting element (12) that makes pressing contact with a contact region (26) of a mechanical resistance element (24) in a trigger pressure position of the trigger (6) between a zero load position and a full load position, the displacement resistance of the trigger (6) being increased by the mechanical resistance element (24), wherein the contact region (26) is arranged outside the switch housing (4).

2. The device switch of claim 1, wherein the contact region (26) is inside the trigger (6).

3. The device switch of claim 2, wherein the resistance element (24) is a spring element that projects with the contact region (26) into a guide space (18) formed at the trigger (6) and can be swiveled out of the guide space (18) at least partially, and the contacting element (12) is supported against the switch housing (4) and has a contacting area (14) that is displaceable in the guide space (18).

4. The device switch of claim 3, wherein a second guide space (22) is formed at the trigger (6), and the contacting area (14) can be displaced in one of the guide spaces (18, 22) as selected.

5. The device switch of claim 1, wherein the position of the contact region (26) is adjustable.

6. The device switch of claim 5, wherein the contact region (26) can be displaced by a spring base (30) that is displaceably supported at the trigger (6), the resistance element (24) being held in the spring base (30).

7. The device switch of claim 6, wherein a threaded element (40) that is rotatable by an adjusting wheel (44) is arranged at the trigger (6) and is mechanically coupled with the spring base (30).

8. The device switch of claim 6, wherein the resistance element (24) makes contact at a rear wall (54) against which the contacting area (14) strikes in a full load position of the trigger (6).

* * * * *